United States Patent [19]

Bösch

[11] 4,102,163

[45] Jul. 25, 1978

[54] DEVICE FOR SECURING SKIS AND SKI STICKS

[76] Inventor: Karl Bösch, Steinbühlweg 57, 4123 Allschwil, Switzerland

[21] Appl. No.: 743,659

[22] Filed: Nov. 22, 1976

[30] Foreign Application Priority Data

Mar. 30, 1976 [CH] Switzerland ..... 3943/76

[51] Int. Cl.[2] ..... E05B 73/00

[52] U.S. Cl. ..... 70/58

[58] Field of Search ..... 70/14, 57, 58; 280/11.37 K, 11.37 A, 11.37 E, 11.37 R, 11.37 C; 211/60 SK; 224/45 S; 24/81 SK

[56] References Cited

U.S. PATENT DOCUMENTS

| | | | |
|---|---|---|---|
| 3,412,585 | 11/1968 | Berryman | 70/58 |
| 3,518,853 | 7/1970 | Bolte | 70/58 |

FOREIGN PATENT DOCUMENTS

| | | | |
|---|---|---|---|
| 142,257 | 2/1935 | Austria | 70/58 |
| 1,406,920 | 6/1965 | France | 70/58 |

*Primary Examiner*—Robert L. Wolfe

*Attorney, Agent, or Firm*—Lowe, King, Price & Markva

[57] ABSTRACT

For securing together a pair of skis and ski sticks a pair of holder members are secured one on the upper face of each ski, and a pivoted securing arm on each holder member can be moved into a position in which it is locked to the holder member of the other ski, thereby retaining the skis and the ski sticks irremovably together. The holder members may be secured to the skis by screws which have a protective cover to prevent access. The locks may have a pivotable protective snow cover. Preferably at least some of the components are coated with a water-repellant plastics material.

7 Claims, 5 Drawing Figures

DEVICE FOR SECURING SKIS AND SKI STICKS

For various reasons it is constantly necessary to bind skis and ski sticks together.

BACKGROUND OF THE INVENTION

When transporting skis it is important for them to be firmly bound together and at the same time to occupy as little space as possible. For conveyance by car, rail, post or cable railway it is usual for the skis to be bound together with the bearing surfaces facing one another. Quite often the ski sticks are bound to the skis with the stick plate between the tips of skis. In some places regulations may exist for packing skis and ski sticks when these are despatched by post or by railway.

For carrying skis and ski sticks it is likewise an advantage for them to be tied together to form a compact packet. It assists carrying and moreover makes it possible to carry with the free hand a further article of luggage or to actuate doors.

For storing skis in a cellar or attic, and for depositing skis and ski sticks in hotels, it is advisable to tie them firmly together.

THE PRIOR ART

Rubber bands are most often used for this purpose, with steel hooks which engage on the outer edge of the ski and are then wound round the ski. Fabric webbing and leather straps are also used, with which the ski sticks are tied simultaneously to the skis. Ski locks are also known in which the skis are locked together with the upper sides of the skis in a locked position.

The drawbacks of these ski and ski stick fastenings which have become known to date differ very much. Tying the skis together with rubber straps and fabric belts is very inconvenient because two skis and two ski sticks always have to be held at the same time, while at the same time the strap has to be looped round. Furthermore, these belts and straps must always be carried in the pockets during skiing. A further even greater drawback is however the fact that all these straps and belts do not ensure adequate protection from theft. Even the ski lock affords no safeguard against the theft of the ski sticks.

At almost all the larger winter sport centers, skiers are provided with ski stands for storing the skis. These are mostly to be found in hotels, mountain railway stations, and mountain restaurants. According to statistics every year more skis are stolen from these ski stands, and it has been found that in particular new skis and expensive skis and ski sticks are preferred.

OBJECT OF THE INVENTION

The object of the present invention is to provide a device for securing skis and ski sticks which is characterized in that securing devices arranged on the upper side of the ski, which are designed at the same time as ski deflectors, have ski and ski stick securing means with which latter the two securing devices can be coupled, the securing means being provided with a locking bolt, the whole being arranged in such a way that skis and ski sticks can be tied to form a rigid unit which makes theft rather difficult.

BRIEF DESCRIPTION OF THE DRAWINGS

In the drawing an embodiment of the invention is shown by way of example, and the drawing.

DESCRIPTION OF THE PREFERRED EMBODIMENT

Figure 2:
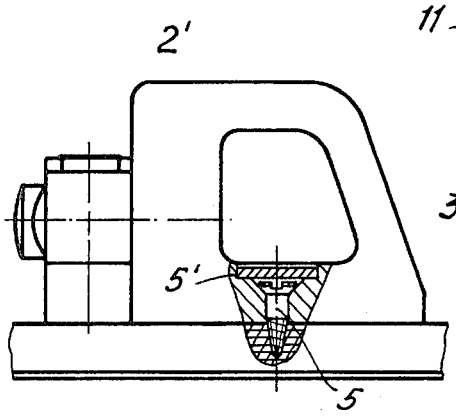
FIG. 2 is an elevation thereof.
Figure 1:
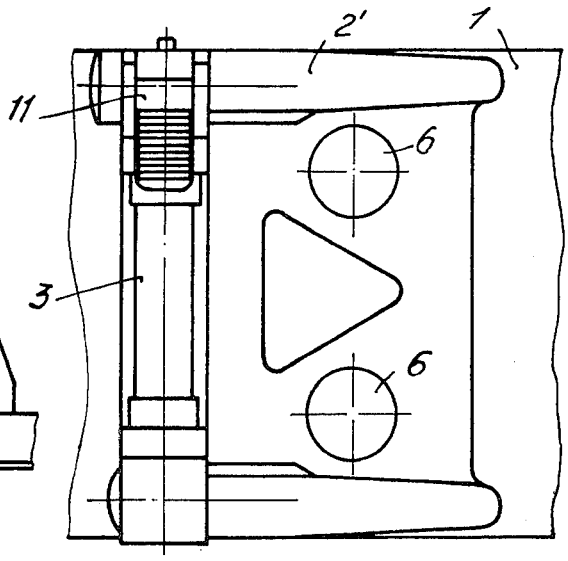
FIG. 1 is a plan view of the holder plate.

Reference numeral 2 denotes holder plates which are rigidly mounted by attachment bolts 5 on the upper sides of skis 1. Protective covers glued over the screws 5 cover them externally so that they are inaccessible. The heads of the screws 5 and the protective covers 6 are countersunk in corresponding recesses 5'. Each supporting plate 2 has, on two opposite sides, projecting jaws 2' forming with the former a rigid whole. Reference 3 denotes ski and ski stick holders, which are shown in FIGS. 1 and 2 in the open and in FIGS. 3,4,5 in the closed position. The ski and ski stick holders engage in the respective holder plate 2; skiing takes place in the open position (FIGS. 1 and 2).

The jaws 2' on the holder plates 2 are designed in such a way that they act at the same time as ski diverters, i.e. the crossing of the skis 1 during skiing is prevented. The structure of the holder plates 2 and the jaws 2' can be different, and the latter can also be designed in the form of straps. The jaws 2', according to FIG. 1 are streamlined, the tapering ends being directed forward.

Figure 3:
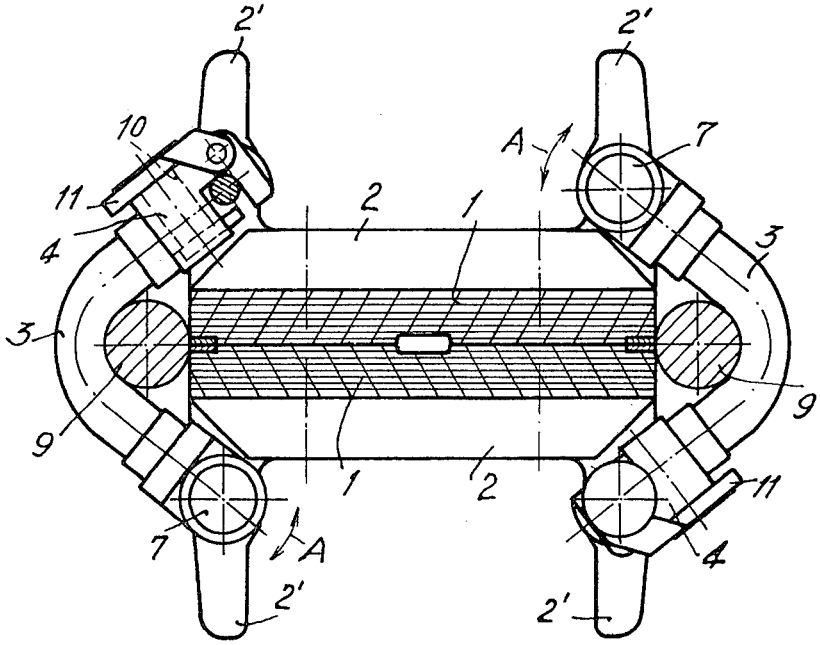
FIG. 3 is a cross-section along the line III—III of FIG. 4.

According to FIG. 3 the holder plates 2 and the jaws 2', which together constitute a holding device, are coupled with one another by the ski and ski stick holders 3. The ski and ski stick holders 3 at the same time grip the ski sticks 9 and ensure reliable cohesion with the skis 1. The ski and ski stick holders 3 are rotatable in the direction of the arrows A (FIG. 3) in the plans of the holder plates 2 about the articulated bolts 7. The latter are in their turn fixed to the transition points of the jaws 2' and the holder plates 2. The holders 3 can engage optionally with the holder plates of one or other of the skis. At the free ends of the ski and ski stick holders 3 there is arranged a lock bolt 4 which prevents unauthorized persons from being able to open the latter. The lock cylinders 10 of the locking bolt 4 are protected by a flap 11 from snow and ice. These flaps can be used simultaneously as a stop in actuating the ski and ski stick holders 3.

Figure 4:
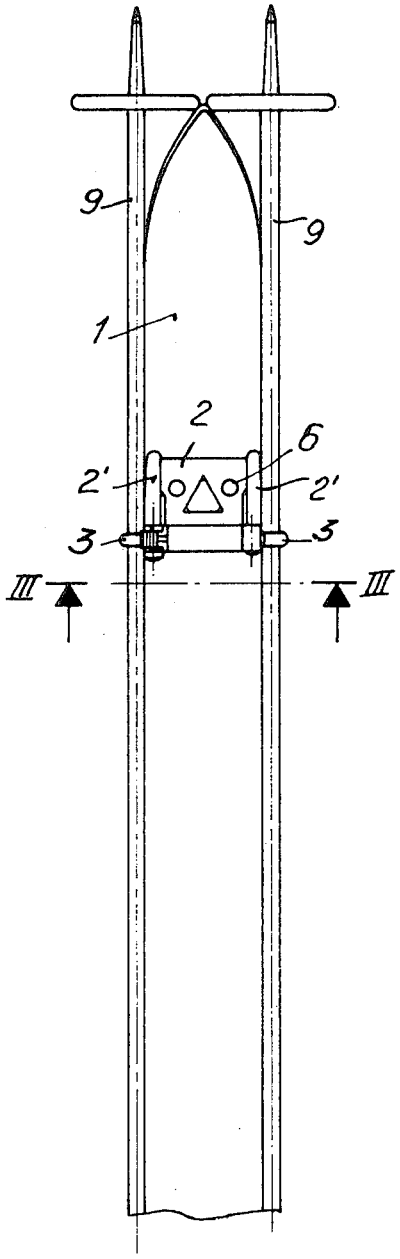
FIG. 4 is a side view in the position of use.
Figure 5:
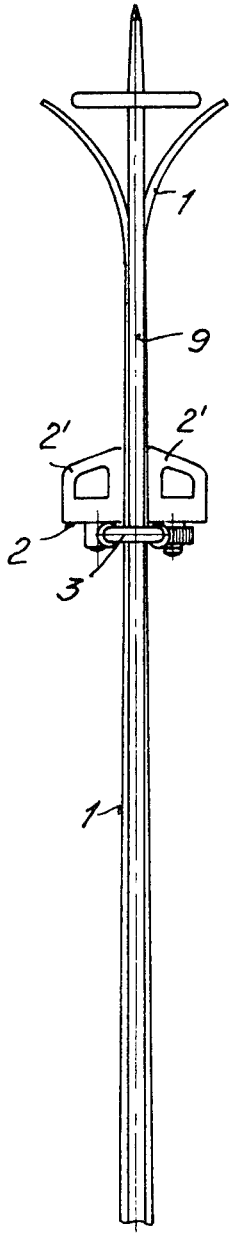
FIG. 5 a similar view but with the skis turned through 90°.

FIGS. 4 and 5 show the device for securing skis and ski sticks in the working position, i.e. in the coupled position. The ski sticks 9 are fixed with their stick plates between the tips of the skis 1 after insertion in the ski stick holders 3.

In this position the skis 1 and the ski sticks 9 are joined rigidly together and form a readily transportable, compact unit, which makes the theft of individual or all of the parts impossible, or at least very difficult.

The device described acts as a good protection from theft and at the same time makes the binding together of the skis and ski sticks easy. The skier is thus saved the trouble of carrying along binding means such as rubber bands, straps etc. For opening the holders 3 from the locked or working position (FIGS. 3,4,5), a suitable key is necessary. The independent opening of the holders 3 during transport is prevented when the holders 3 are locked.

The loss of individual parts of the ski equipment from the securing position (FIGS. 3,4,5) during transport is normally likewise precluded. The jaws 2' which are directed upwards from the holder plates 2 perform in addition, during skiing, a ski-deflecting function which counteracts the crossing of the skis.

All or individual components of the described device consist for instance of metal, and are for preference coated with snow and water-repelling plastic. Components thereof can, however, consist entirely of plastic, in which case tough resilient material would be most suitable.

I claim:

1. A device for securing skis and ski sticks together comprising:

(i) a pair of holder members for disposing one on the upper face of each of a pair of skis (ii) a pair of securing arms, each securing arm being mounted by a respective pivot on a respective holder member (iii) a pair of lock and lock bolt assemblies, each assembly having one of said items on a respective arm and the other of said items on the other of the two holder members, the arrangement being such that, with the pair of skis disposed bearing-surface to bearing-surface and with a pair of ski sticks disposed one at each side of the skis, the securing arms in locked condition serve to retain the skis and ski sticks secured together.

2. A device, as claimed in claim 1, wherein each holder member comprises a plate for securing to the upper face of a ski, and a pair of jaws spaced transversely of the ski and upstanding from said plate to serve as a deflector to prevent crossing of skis during skiing.

3. A device, as claimed in claim 2, wherein said jaws are streamlined.

4. A device, as claimed in claim 1, comprising means for securing said holder members irremovably to a respective ski.

5. A device, as claimed in claim 4, wherein said securing means are screws, and wherein protective covers are provided to prevent access to said screws.

6. A device, as claimed in claim 1, comprising a respective snow cover for each lock.

7. A device, as claimed in claim 1, comprising a coating of water-repellant plastics material on at least one of said holder members, said securing arms and said lock and bolt assemblies.

* * * * *